US009048577B2

(12) United States Patent
Kobayashi

(10) Patent No.: US 9,048,577 B2
(45) Date of Patent: Jun. 2, 2015

(54) LEVER CONNECTOR WITH WATERPROOFING

(71) Applicant: Yazaki Corporation, Tokyo (JP)

(72) Inventor: Naoki Kobayashi, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 47 days.

(21) Appl. No.: 13/957,755

(22) Filed: Aug. 2, 2013

(65) Prior Publication Data

US 2013/0316558 A1 Nov. 28, 2013

Related U.S. Application Data

(63) Continuation of application No. PCT/JP2012/053286, filed on Feb. 13, 2012.

(30) Foreign Application Priority Data

Feb. 15, 2011 (JP) ..... 2011-030102

(51) Int. Cl.
*H01R 4/50* (2006.01)
*H01R 13/625* (2006.01)
(Continued)

(52) U.S. Cl.
CPC ..... *H01R 13/62933* (2013.01); *H01R 13/5202* (2013.01); *H01R 13/62966* (2013.01); *H01R 13/741* (2013.01)

(58) Field of Classification Search
CPC .... H01R 13/629; H01R 13/743; H01R 13/74; H01R 13/745; H01R 13/62933; H01R 13/639
USPC ..... 439/341, 556, 557, 559, 157, 372
See application file for complete search history.

(56) References Cited

U.S. PATENT DOCUMENTS 5,259,788 A 11/1993 Nishimura et al.
5,775,944 A * 7/1998 Flask et al. ..... 439/556
(Continued)

FOREIGN PATENT DOCUMENTS

JP 4-118583 U 10/1992
JP 10-233262 A 9/1998
(Continued)

OTHER PUBLICATIONS

International Search Report and Written Opinion of the International Search Report for PCT/JP2012/053286 dated May 1, 2012.
(Continued)

*Primary Examiner* — Hae Moon Hyeon
(74) *Attorney, Agent, or Firm* — Kenealy Vaidya LLP

(57) ABSTRACT

A lever connector includes a first connector housing, a second connector housing that includes a distal fitting portion to which a distal end of the first connector housing is fittedly connected, and is attached to a connector attaching plate in a state of inserting the second connector housing through a connector attaching hole of the connector attaching plate, a lever pivotally that is equipped on the first connector housing and fits the first connector housing into the second connector housing by a pivoting operation of the lever, and a grommet that is mounted on the first connector housing and ensures a waterproofing property of an inside of the first connector housing. The lever includes a lever body and an operation plate. The grommet includes an operation plate a tubular portion.

4 Claims, 10 Drawing Sheets

(51) Int. Cl.

| | |
|---|---|
| ***H01R 13/629*** | (2006.01) |
| ***H01R 13/52*** | (2006.01) |
| ***H01R 13/74*** | (2006.01) |

(56) References Cited

U.S. PATENT DOCUMENTS

| | | | | |
|---|---|---|---|---|
| 5,904,584 | A * | 5/1999 | Flask et al. | 439/157 |
| 5,975,929 | A * | 11/1999 | Matsuura et al. | 439/157 |
| 6,033,241 | A | 3/2000 | Iwata et al. | |
| 6,095,855 | A | 8/2000 | Iwata et al. | |
| 6,183,275 | B1 * | 2/2001 | Okura et al. | 439/157 |
| 6,321,446 | B1 | 11/2001 | Iwata et al. | |
| 7,201,609 | B2 * | 4/2007 | Ishikawa | 439/587 |
| 8,851,910 | B2 * | 10/2014 | Kobayashi | 439/157 |
| 2003/0109166 | A1 * | 6/2003 | Ookura | 439/372 |
| 2013/0323953 | A1 * | 12/2013 | Oshita | 439/271 |

FOREIGN PATENT DOCUMENTS

| | | | |
|---|---|---|---|
| JP | 11-86961 | A | 3/1999 |
| JP | 11-97106 | A | 4/1999 |
| JP | 2002-151214 | A | 5/2002 |
| JP | 2005-166575 | A | 6/2005 |
| JP | 2005-251569 | A | 9/2005 |
| WO | WO 2012111619 | A1 * | 8/2012 |

OTHER PUBLICATIONS

Korean Notice of Allowance for the related Korean Patent Application No. 10-2013-7021501 dated Jul. 9, 2014.

* cited by examiner

-- Related Art --

LEVER CONNECTOR WITH WATERPROOFING

CROSS REFERENCE TO RELATED APPLICATION

This application is a continuation of PCT application No. PCT/JP2012/053286, which was filed on Feb. 13, 2012 based on Japanese Patent Applications No. 2011-030102 filed on Feb. 15, 2012, the contents of which are incorporated herein by reference.

BACKGROUND OF THE INVENTION

1. Technical Field

The present invention relates to a lever connector, in which a second connector housing to be fitted with a first connector housing is attached as a standby connector on a connector attaching plate, the first connector housing is equipped with a waterproofing grommet, and a fitting connection between the first connector housing and the second connector housing is obtained by a pivoting operation of a lever equipped on the first connector housing.

2. Background Art

FIG. 8 shows an example of a lever connector according to the related art.

A lever connector 100 shown in the figure is that disclosed in PTL1 as described below, and is used for connecting electric wires inside and outside a connector attaching plate (panel) 130, such as a door panel for vehicles.

The lever connector 100 is configured such that a second connector housing 120 to be fitted with a first connector housing 110 is attached as a standby connector on the connector attaching plate 130 and the first connector housing 110 is equipped with a waterproofing grommet 140. Also, in the lever connector 100, a fitting connection between the first connector housing 110 and the second connector housing 120 is obtained by a pivoting operation of a lever 150 equipped on the first connector housing 110.

The first connector housing 110 includes a housing body 112 and an outer case 113 for accommodating and holding the housing body 112 via the grommet 140.

The housing body 112 has a plurality of terminal receiving holes 111 for receiving a first connection terminal. The housing body 112 is pressed into the grommet 140, after the grommet 140 is mounted on the outer case 113.

The second housing 120 includes a housing body 122, a cylindrical-shaped hood portion 123 formed to be extended from a front end of the housing body 122, and a panel engaging portion 124 formed on the hood portion 123.

The housing body 122 has a plurality of terminal receiving holes 121 for receiving a second connection terminal, which is adapted to be fitted with the first connection terminal inside the first connector housing 110.

The hood portion 123 is a component into which a portion, which is holding the housing body 112 of the first connector housing 110, is fitted. On an inside surface of the hood portion 123, a guide shaft 127 capable of engaging with the lever 150 is formed to protrude therefrom.

The panel engaging portion 124 has a shape of a groove, in which a peripheral edge of a connector attaching hole 131 formed in the connector attaching plate 130 is engaged, and fixes the second connector housing 120 to the connector attaching plate 130.

To prevent rattling, the panel engaging portion 124 is equipped with an elastic ring 133 or a retaining spring 134.

The grommet 140 includes a body accommodating portion 141 mounted on the inner peripheral surface of the outer case 113 in a tightly contact state and adapted for the housing body 112 to be pressed therein, and a tubular portion 142 extended from the outer case 113 to the outside. The tubular portion 142 receives a cable connected to the first connector housing 110.

The lever 150 is pivotally supported on a lever supporting shaft 116 formed to protrude from an outside surface of the outer case 113. A guide groove 157, in which the guide shaft 127 of the second connector housing 120 is engaged, is notched in the lever 150. Upon a pivoting operation, the lever 150 forces the first connector housing 110 to be pulled into the second connector housing 120 by pulling the guide shaft 127, which has been engaged in the guide groove 157, toward a terminating end of the guide groove 157.

The first connector housing 110 is pulled into the second connector housing 120 by the pivoting operation of the lever 120, and as a result, the first connector housing 110 is fitted and connected to the second connector housing 120.

CITATION LIST

Patent Document

PTL1: JP-A-2005-166575

SUMMARY OF THE INVENTION

However, in the lever connector 100 disclosed in PTL1, a waterproofing grommet 140 is mounted inside the first connector housing 110. Therefore, the first connector housing 110 or the second connector housing 120 must have a large volume allowing the grommet 140 to be accommodated therein, thereby causing a problem in which sizes of the connector housings are increased to allow the grommet 140 to be mounted therein.

Also, in the lever connector 100 disclosed in PTL1, the grommet 140 must be carefully mounted on the outer case 113 so that an outer peripheral surface of the body accommodating portion 141 is tightly contacted with the inside surface of the outer case 113. As a result, there is a problem in which mounting of the grommet 140 takes time, and thus assembly efficiency thereof is poor.

Further, in the lever connector 100 disclosed in PTL1, a significant change in the exterior appearance before and after a fitting connection between the first connector housing 110 and the second connector housing 120 has been completed is not occurred. Therefore, there is also a problem in which whether or not the fitting connection between the first connector housing 110 and the second connector housing 120 has been successfully completed is not simply distinguished by the external appearance or the like.

Accordingly, an object of the present invention is to solve the above problems, and to provide a lever connector, in which increasing in size of connector housings to allow a grommet to be mounted therein is prevented, the grommet is be easily mounted, and also whether or not the fitting connection between the connector housings has been successfully completed is simply distinguished by observing the external appearance.

Solution to Problem

The object of the present invention is achieved by the following configurations.

(1) A lever connector includes a first connector housing, a second connector housing that includes a distal fitting portion to which a distal end of the first connector housing is fittedly connected, and is attached to a connector attaching plate in a state of inserting the second connector housing through a connector attaching hole of the connector attaching plate, a lever pivotally that is equipped on the first connector housing and fits the first connector housing into the second connector housing by a pivoting operation of the lever, and a grommet that is mounted on the first connector housing and ensures a waterproofing property of an inside of the first connector housing. The lever includes a lever body pivotally coupled to the first connector housing and pulls the first connector housing into the second connector housing by pivoting the lever, and an operation plate that is extended from a rear end of the lever body and serves as an operation portion for pivoting the lever body. When fitting between the connector housings is completed by the pivoting operation, the operation plate is moved toward the connector attaching plate in a state where the operation plate is parallel to the connector attaching plate and protrudes beyond an outer peripheral of the first connector housing in a flange shape. The grommet includes an operation plate covering portion that is coupled to the operation plate by a lip of the operation plate, the lip having a groove to be fitted on an outer peripheral edge of the operation plate, and a tubular portion that is integrally formed with the operation plate covering portion and receives a cable connected to the first connector housing. When fitting between the connector housings has been completed by the pivoting operation of the lever, the lip is tightly contacted with a peripheral edge of the connector attaching hole by movement of the operation plate toward the connector attaching plate to ensure the waterproofing property of the inside of the first connector housing.

(2) In the lever connector of (1), the second connector housing includes a panel fixing piece that performs a temporary fixation to the connector attaching plate when the distal fitting portion is inserted through the connector attaching hole in a state where the second connector housing is not connected to the first connector housing. The first connector housing includes a temporary fixation maintaining device that restricts a bending displacement of the panel fixing piece while the first connector housing is being fitted into the second connector housing to maintain the second connector housing in a fixed state to the connector attaching plate by the panel fixing piece, and that releases the restriction to the bending displacement of the panel fixing piece to allow a displacement of the second connector housing relative to the connector attaching plate when the first connector housing is completely fitted into the second connector housing. The operation plate of the lever includes a main fixation device that is engaged with a housing fixing portion of the connector attaching plate to fix the first connector housing to the connector attaching plate in a state where the lip is tightly contacted with the peripheral edge of the connector attaching hole, when the operation plate is pressed against the connector attaching plate in a state where the first connector housing is completely fitted into the second connector housing.

(3) In the lever connector of (1) or (2), the first connector housing is provided with a lever supporting shaft for pivotally supporting the lever, on a symmetrical axis extending through the center of a width direction of the first connector housing. The lever includes a pair of half levers supported by the lever supporting shaft and pulls the first connector housing into the second connector housing when being pivoted in opposite directions to each other, the pair of half levers having the same structure. The lever includes a pair of half levers supported on the lever supporting shaft and adapted to force the first connector housing to be pulled into the second connector housing when being pivoted in opposite directions to each other, the pair of half levers having the same structure.

According to the configuration of the above (1), the grommet ensuring the waterproofing property of preventing that infiltration of water or the like into the first connector housing has no portion, which is mounted inside the first connector housing, and is attached on the operation plate of the lever, which is exposed to the outside of the first connector housing. Therefore, it is not necessary to ensure a volume for accommodating the grommet inside the first connector housing. As a result, increasing in size of the connector housings to allow the grommet to be mounted therein is prevented.

Also, according to the configuration of the above (1), the grommet is attached on the operation plate of the lever, which is exposed to the outside of the first connector housing, and thus as compared to conventional cases in which a portion of the grommet is fitted into the first connector housing, the grommet is easily mounted, thereby enhancing assembly efficiency.

According to the configuration of the above (2), when the first connector housing is fitted into the second connector housing, which has been temporarily fixed on the connector attaching plate by the panel fixing piece, the temporary fixation maintaining device of the first connector housing restricts a bending displacement of the panel fixing piece while fitting is being performed, and therefore, the second connector housing is maintained in a fixed state to the connector attaching plate by means of the panel fixing piece. In addition, if the first connector housing has been completely fitted into the second connector housing, the restriction to the bending displacement of the panel fixing piece by the temporary fixation maintaining device is released. As a result, due to a pressing force exerted from the first connector housing to the second connector housing, the second connector housing is displaced in a direction, in which the second connector housing is pushed out of the connector attaching hole. At this time, such a displacement is stopped when the main fixing device provided on the operation plate of the lever has been engaged with the housing fixing portion of the connector attaching plate.

In other words, there is a significant change between attaching locations of the second connector housing to the connector attaching plate before and after the fitting connection of the first connector housing has been completed. Therefore, whether or not the fitting connection between the connector housings has been successfully completed is simply distinguished by observing the external appearance.

According to the configuration of the above (3), the lever adapted to force the first connector housing to be fitted and connected to the second connector housing is constituted of a pair of half levers having the same structure, thereby inhibiting increase of component types to be manufactured and achieving reduction of manufacturing cost.

BRIEF DESCRIPTION OF DRAWINGS

FIGS. 5A to 5E are explanatory views showing operations of the lever in a process of fitting and connecting the first connector housing and the second connector housing shown in FIG. 1 to each other, in which FIG. 5A shows an unconnected state, FIGS. 5B to 5C show a state while fitting is being performed, FIG. 5D shows a temporarily fixed state in which the second connector housing is fixed to the connector attaching plate after a fitting connection has been completely fitted and connected, and FIG. 5E shows a regular fixation state in which the first connector housing, which has been completely fitted and connected, is fixed to the connector attaching plate.

FIGS. 6A to 6C are explanatory views showing operations of temporary fixation maintaining devices in a process of fitting and connecting the first connector housing and the second connector housing shown in FIG. 1 to each other, in which FIG. 6A shows a temporarily fixing state of the temporary fixation maintaining devices while fitting is being performed, FIG. 6B shows a temporarily fixing state of the temporary fixation maintaining devices when a fitting connection has been completed, and FIG. 6C shows a state in which the temporary fixation maintaining devices are released after the fitting connection has been completed.

FIGS. 7A to 7C are explanatory views showing operations, in which the grommet is tightly contacted with the connector attaching plate, in a process of fitting and connecting the first connector housing and the second connector housing shown in FIG. 1 to each other, in which FIG. 7A shows an unconnected state, FIG. 7B shows a state before a rip is tightly contacted with a peripheral edge of a connector attaching hole after the fitting connection has been completed, and FIG. 7C shows a state in which a ridge of the rip is tightly contacted with the peripheral edge of the connector attaching hole after the fitting connection has been completed.

DESCRIPTION OF EMBODIMENTS

A preferred embodiment of a lever connector according to the present invention will be now described in detail with reference to the accompanying drawings.

Figure 1:
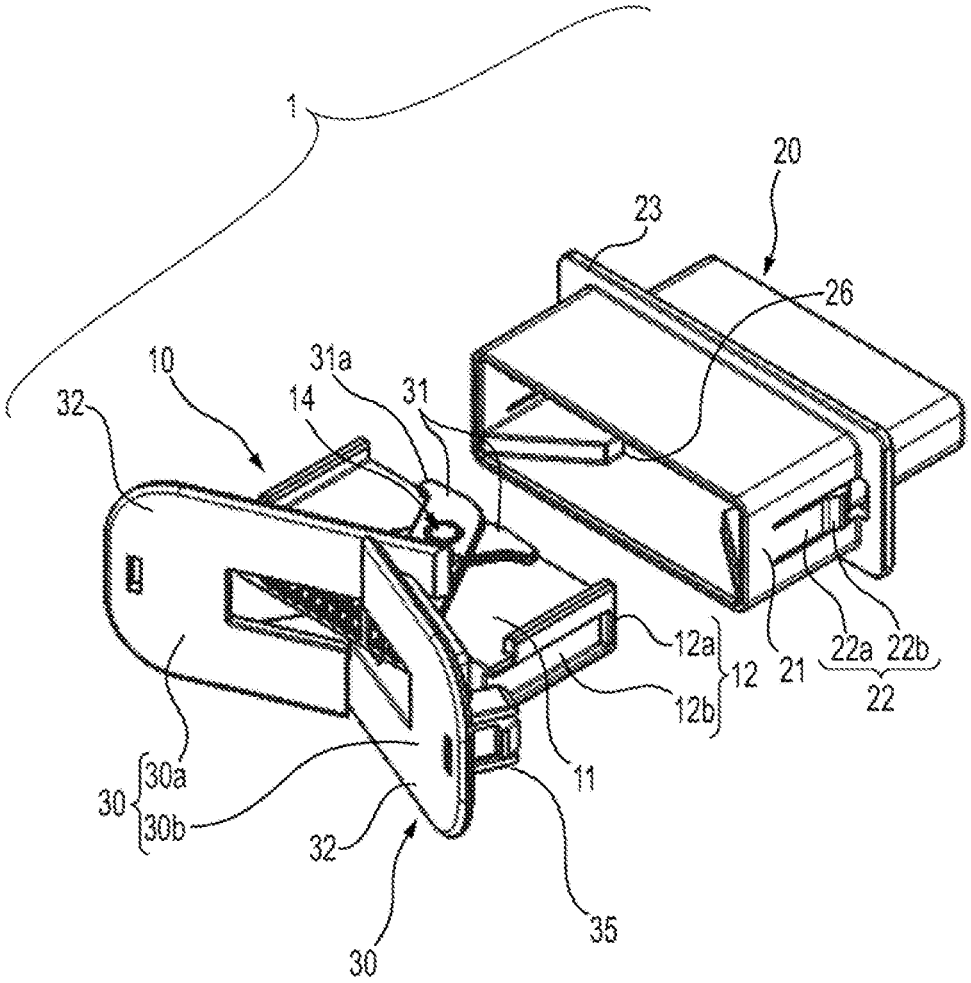
FIG. 1 is an exploded perspective view showing one embodiment of a lever connector according to the present invention.
Figure 2:
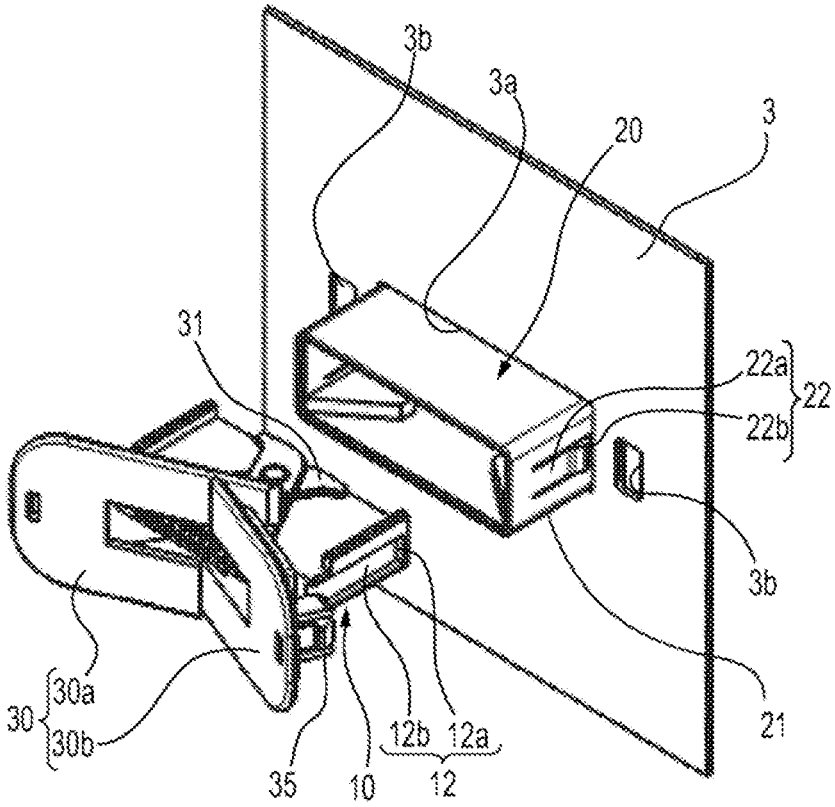
FIG. 2 is a perspective view showing a state in which a second connector housing shown in FIG. 1 is temporarily fixed to a connector attaching plate.
Figure 3:
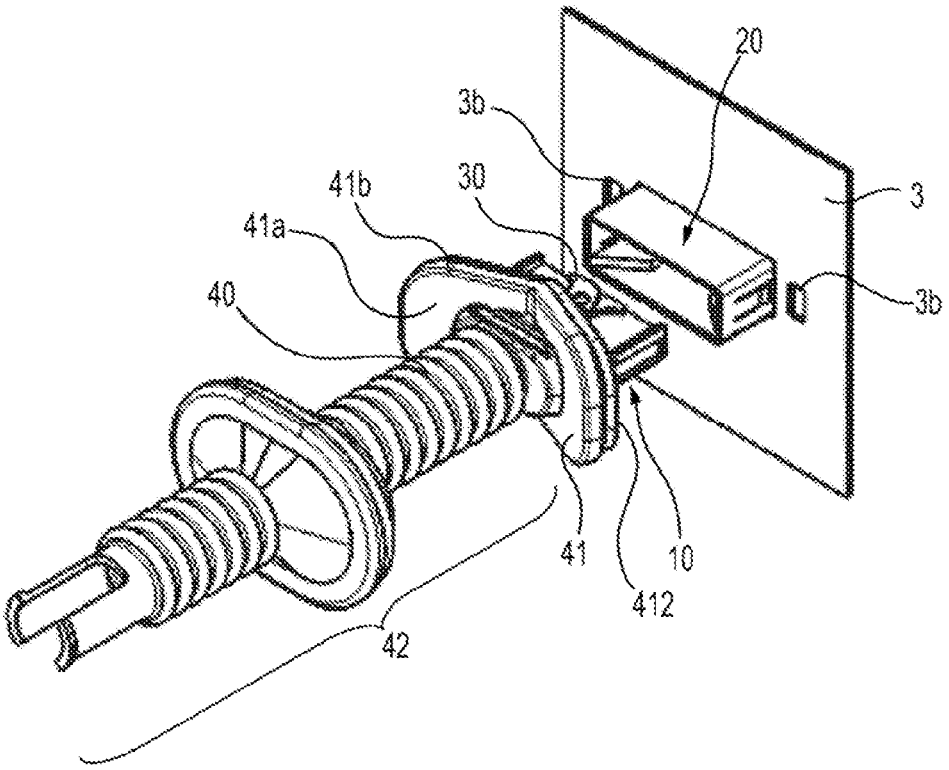
FIG. 3 is a perspective view showing a state in which a grommet is attached to a first connector housing shown in FIG. 2.
Figure 4:
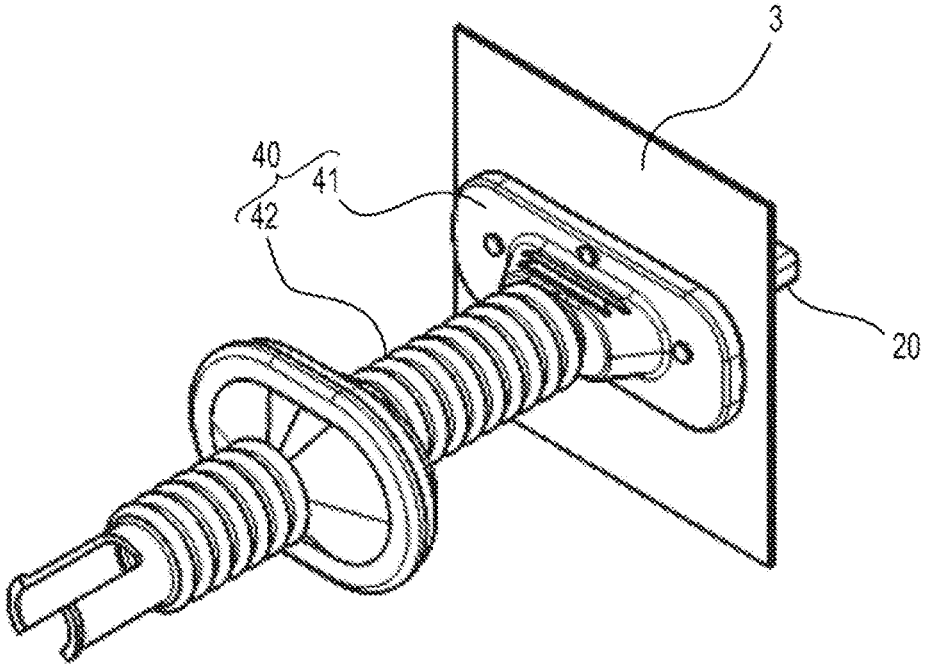
FIG. 4 is a perspective view showing a state in which a fitting connection between the first connector housing and the second connector housing shown in FIG. 3 has been completed.

A lever connector 1 according to the embodiment is used for connecting electric wires inside and outside a connector attaching plate 3 which is, for example, a panel for vehicles, and as shown in FIGS. 1 to 3, includes a first connector housing 10, a second connector housing 20, a lever 30, and a grommet 40.

The first connector housing 10 is a connector housing intended for an electric wire outside the connector attaching plate 3 to be connected thereto. The first connector housing 10 has temporary fixation maintaining devices 12 respectively provided on both of left and right sides of a distal end 11 thereof adapted to be fitted into the second connector housing 20 as described below. Also, the first connector housing 10 is provided with a lever supporting shaft 14 for pivotally supporting the lever 30, on a symmetrical axis L1 (see FIG. 5A), which extends through the center of a width direction of the first connector housing 10. The temporary fixation maintaining devices 12 and the lever 30 will be described below.

The second connector housing 20 is a standby connector adapted to wait on the connector attaching plate 3 to be fittedly connected to the first connector housing 10. The second connector housing 20 has a distal fitting portion 21 intended for the first connector housing 10 to be fittedly connected thereto. In addition, the second connector housing 20, as shown in FIG. 2, is attached to the connector attaching plate 3 in a state of inserting the distal fitting portion 21 through a connector attaching hole 3*a* of the connector attaching plate 3.

In the present embodiment, the second connector housing 20 includes panel fixing pieces 22 adapted to perform a temporary fixation to the connector attaching plate 3, when the distal fitting portion 21 is inserted through the connector attaching hole 3*a* in a state in which the second connector housing 20 is not connected to the first connector housing 10, and a positioning flange 23.

The panel fixing pieces 22 are respectively provided on both of left and right sides of the distal fitting portion 21. The panel fixing pieces 21 each has a structure in which an engaging protrusion 22*b* is provided on a free end of an elastic piece 22*a* thereof extending along a direction of inserting the distal fitting portion 21 into the connector attaching hole 3*a*.

Figure 6A:
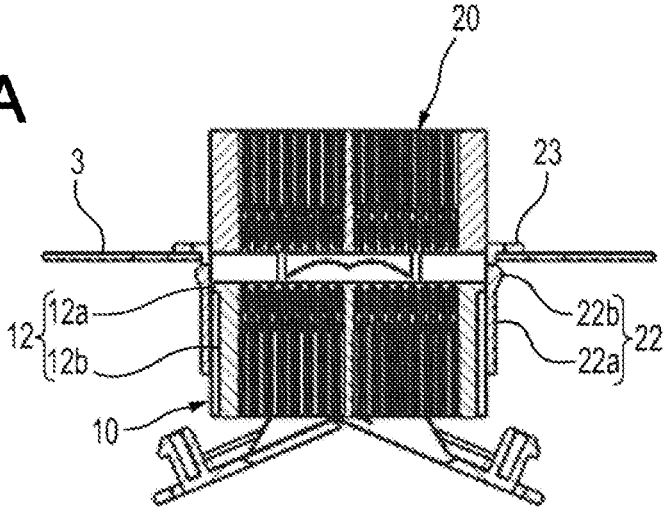

When the distal fitting portion 21 is inserted through the connector attaching hole 3*a*, the positioning flange 23, as shown in FIG. 6A, is abutted on a rear surface of the connector attaching pate 3, and thus performs positioning to the connector attaching plate 3.

Figure 6B:
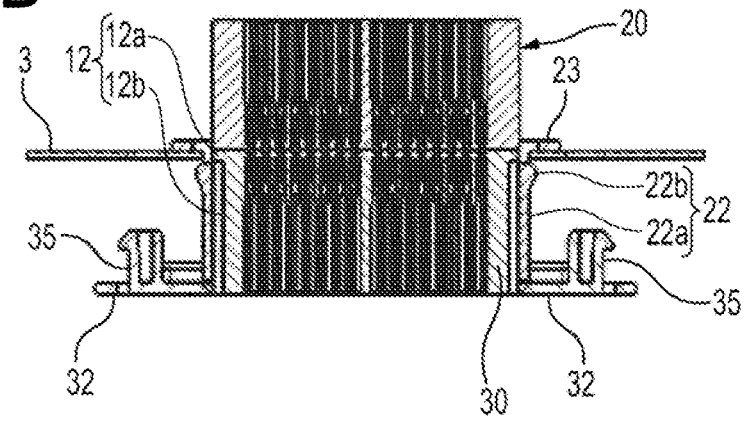

As shown in FIGS. 6A and 6B, the panel fixing pieces 22 are adapted to sandwich a peripheral edge of the connector attaching hole 3*a* between the positioning flange 23 and the engaging protrusions 22*b*, thereby providing a temporary fixation of the second connector housing 20 to the connector attaching plate 3.

Figure 6C:
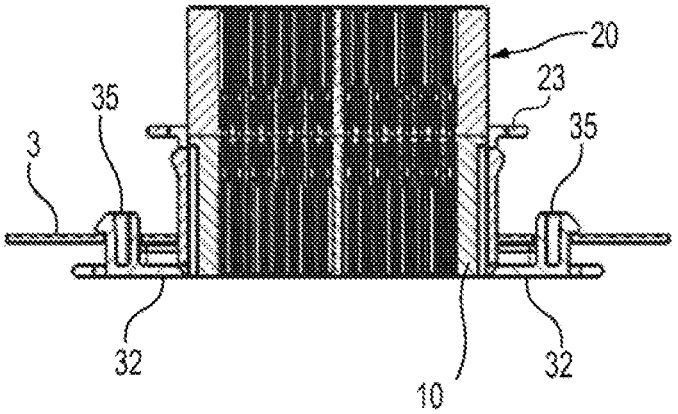

As shown in FIG. 1, the temporary fixation maintain devices 12 provided on the first connector housing 10 are each constituted of a protrusion 12*a* provided on the distal end 11 of the first connector housing 10 and a relief groove 12*b* extending backward from the protrusion 12*a*. The protrusions 12*a*, as shown in FIG. 6A, are abutted on rear surfaces of the panel fixing pieces 22 while the first connector housing 10 is being fitted into the second connector housing 20, so that a bending displacement of the panel fixing pieces 22 in a direction in which an engagement to the peripheral edge of the connector attaching hole 3*a* sandwiched between the panel fixing pieces 22 and the positioning flange 23 is released is restricted. Also, the relief grooves 12*b*, as shown in FIGS. 6B and 6C, are located on the backside of the panel fixing pieces 22 when the first connector housing 10 has been completely fitted into the second connector housing 20, so that the bending displacement of the panel fixing pieces 22 in the direction in which the engagement to the peripheral edge of the connector attaching hole 3*a* sandwiched between the panel fixing pieces 22 and the positioning flange 23 is released is allowed.

Namely, the temporary fixation maintaining devices 12 according to the present embodiment restrict the bending displacement of the panel fixing pieces 22 while the first connector housing 10 is being fitted into the second connector housing 20, so that the second connector housing 20 is maintained in a fixed state to the connector attaching plate 3 by means of the positioning flange 23 and the panel fixing pieces 22. In addition, the temporary fixation maintaining devices 12 release the restriction to the bending displacement of the panel fixing pieces 22 when fitting between the first connector housing 10 and the second connector housing 20 has been completed, so that a displacement of the second connector housing 20 in a direction in which the distal fitting portion 21 is pushed out of the connector attaching hole 3*a* relative to the connector attaching plate 3 is allowed.

The lever 30 is pivotally equipped on the lever supporting shaft 14 of the first connector housing 10, and thus forces the first connector housing 10 to be fitted into the second connector housing 20 by a pivoting operation of the lever 30.

In the present embodiment, the lever 30 includes a pair of half levers 30*a* and 30*b*. The pair of half levers 30*a* and 30*b* are pivotally supported on the lever supporting shaft 14 and when being pivoted in opposite directions to each other, forces the first connector housing 10 to be pulled into the second connector housing 20. In the embodiment, both of the pair of half levers 30*a* and 30*b* have the same structure of including a lever body 31 and an operation plate 32.

Figure 5A:
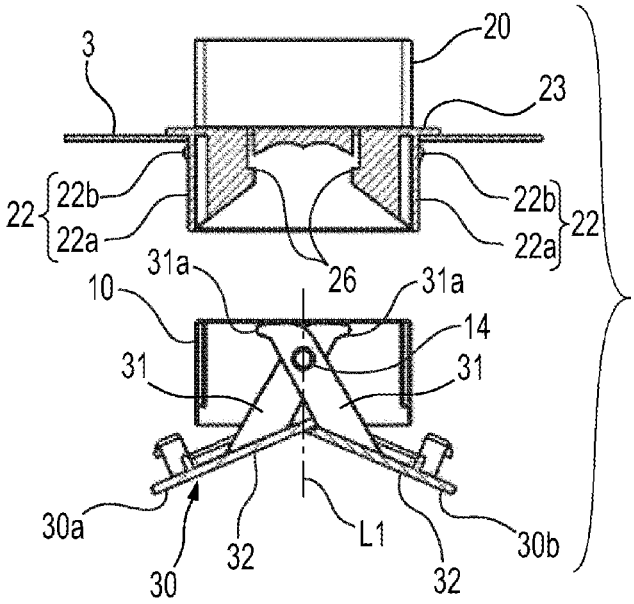
Figure 5B:
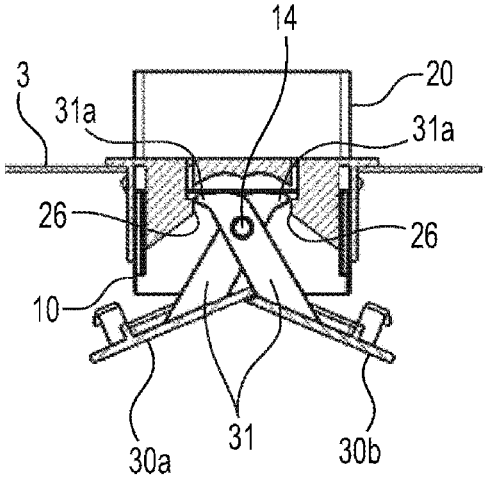
Figure 5C:
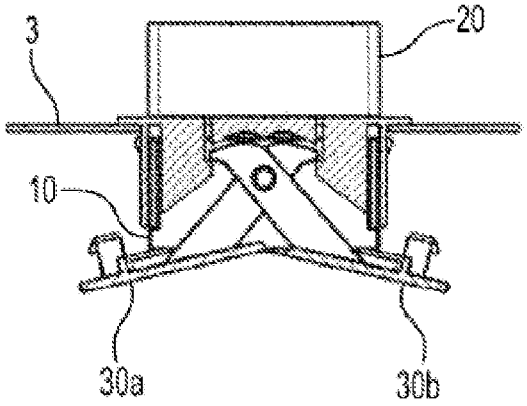

As shown in FIG. 5A, the lever body 31 in each of the half levers 30*a* and 30*b* has, at a distal end thereof, a protrusion 31*a* adapted to be engaged with a lever engaging step section 26 inside the second connector housing 20. Each of lever bodies 31 is pivoted to force the first connector housing 10 to be pulled into the second connector housing 20.

The operation plate 32 in each of the half levers 30*a* and 30*b* is a plate-shaped portion extended from a rear end of the lever body 31 and serves as an operation portion when attempting to pivot the lever body 31.

Figure 5D:
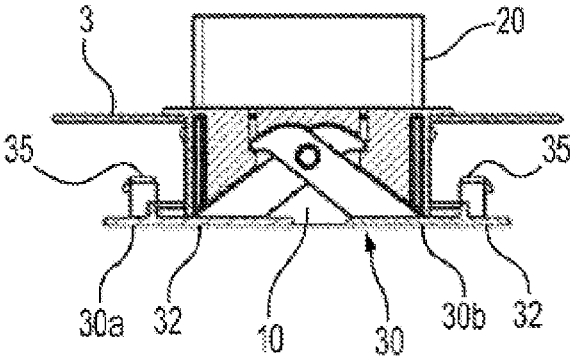
Figure 5E:
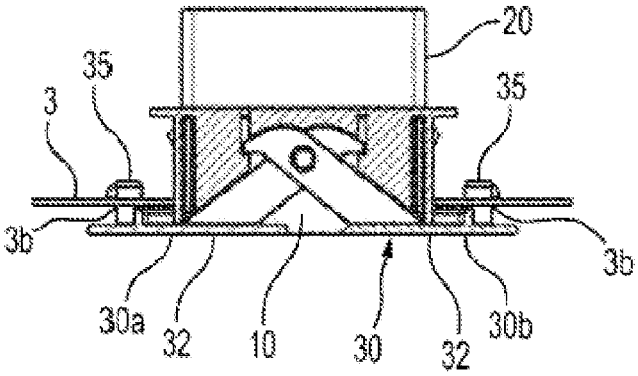

In the lever 30 according to the present embodiment, when fitting between the connector housings has been completed by a pivoting operation of the pair of half levers 30*a* and 30*b*, as shown in FIGS. 5D and 5E, the operation plates 32 are moved toward the connector attaching plate 3, in a state in which the operation plates 32 are parallel to the connector attaching plate 3 and protrude beyond the outer peripheral of the first connector housing 10 in a flange shape.

The operation plate 32 in each of half levers 30*a* and 30*b* has a main fixation device 35.

As shown in FIG. 5E, the main fixation devices 35 are engaged with a housing fixing portion 3*b* of the connector attaching plate 3 to fix the first connector housing 10 to the connector attaching plate 3, when the operation plates 32 are pressed against the connector attaching plate 3 in a state in which fitting between the first connector housing 10 and the second connector housing 20 has been completed.

The grommet 40 is mounted on the first connector housing 10, thereby ensuring a waterproofing property of preventing infiltration of water or the like into the first connector housing 10.

The grommet 40 according to the present embodiment is made of an elastic material, such as a synthetic rubber, having a waterproofing property, and as shown in FIG. 3, includes an operation plate covering portion 41 adapted to be coupled to the operation plates 32, and a tubular portion 42 integrally formed with the operation plate covering portion 41. The tubular portion 42 receives a cable, not shown, connected to the first connector housing 10.

As shown in FIG. 3, the operation plate covering portion 41 has a lip 41*b* formed along the entire circumference of an outer peripheral edge of a generally elliptical-shaped covering portion body 41*a* adapted to cover an outside surface of a pair of operation plates 31.

Figure 7A:
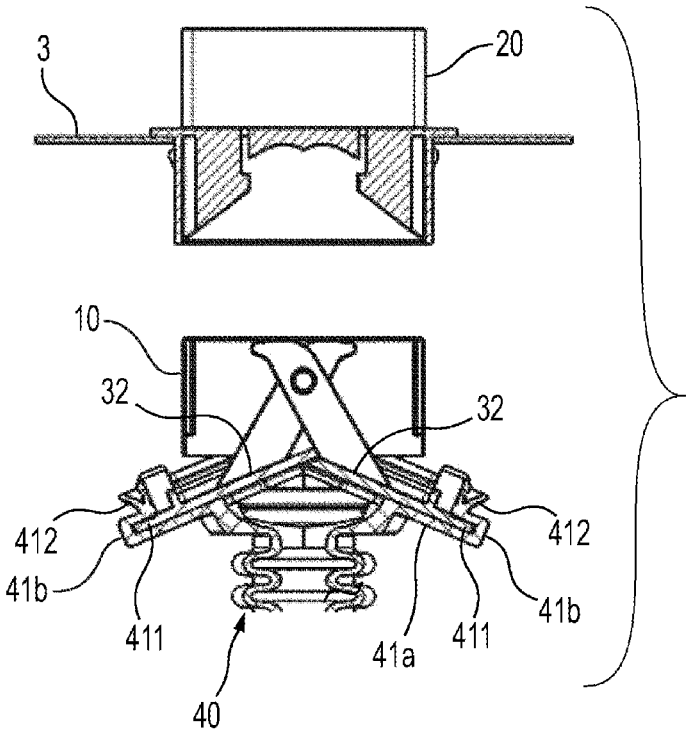
Figure 7B:
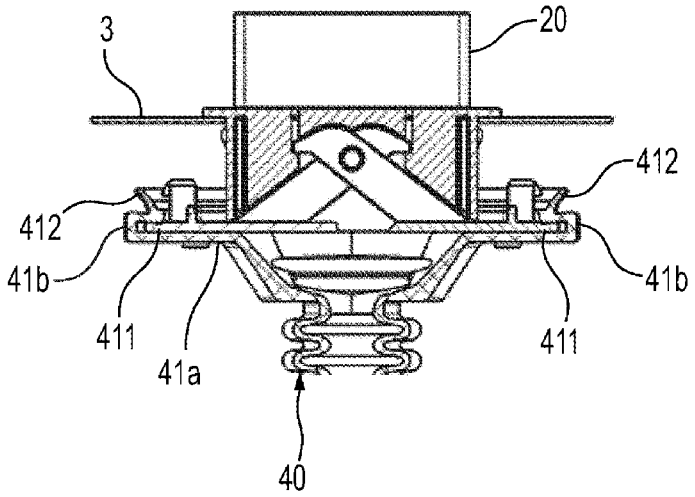

As shown in FIG. 7A, the lip 41*b* has a groove 411 adapted to be fitted on outer peripheral edges of the operation plates 32, and a ridge 412 slantly extending toward the connector attaching plate 3.

The grommet 40 is coupled to the operation plates 32 by fitting outer peripheral edges of the operation plates 32 into the groove 411 of the lip 41*b* of the operation plate covering portion 41.

Figure 7C:
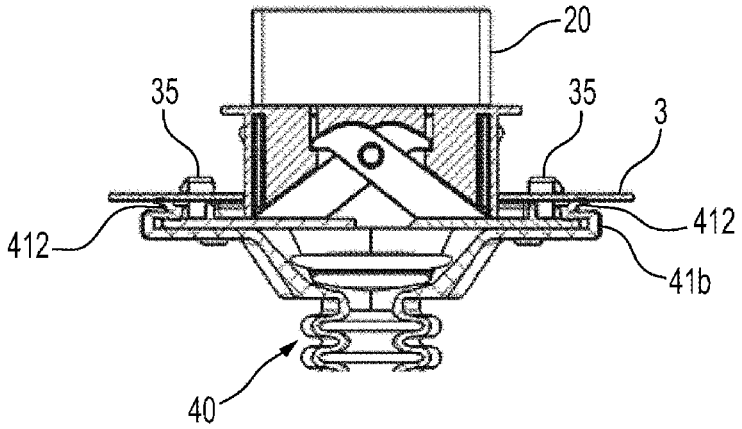
Figure 8:
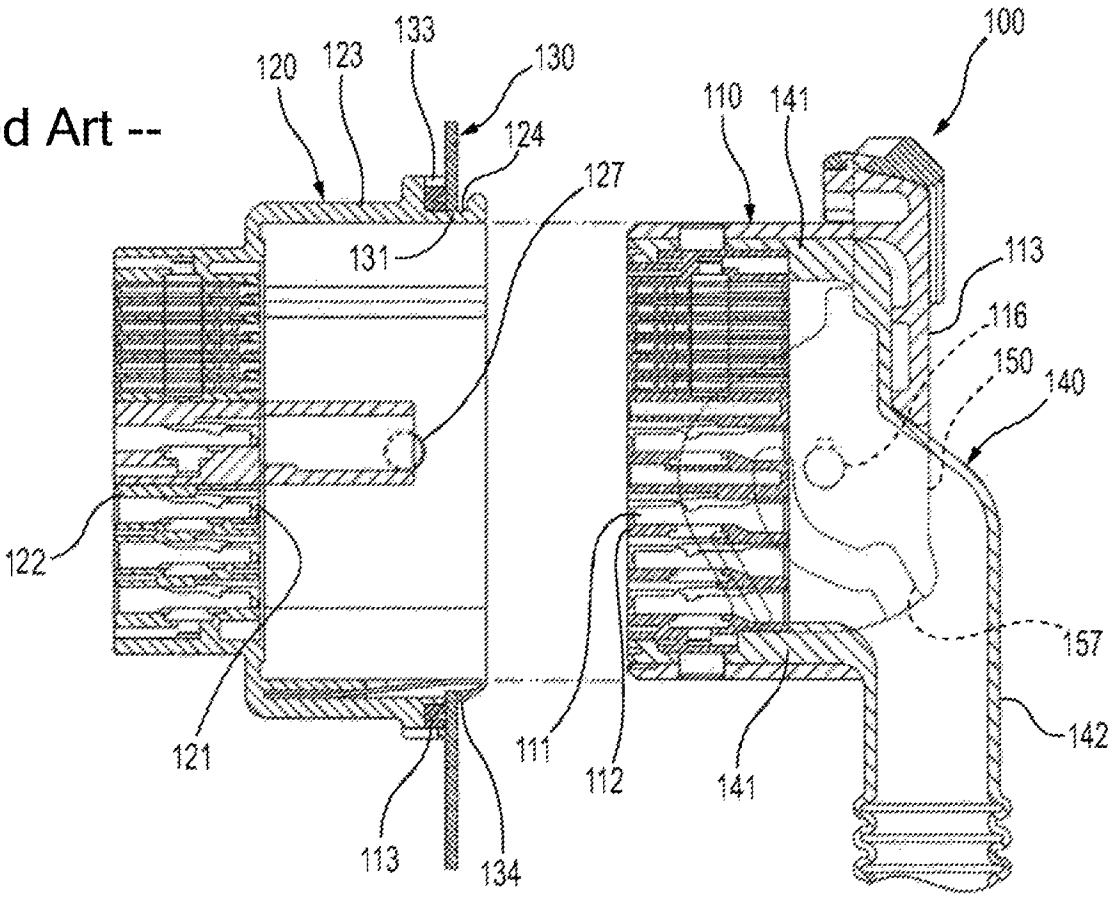
FIG. 8 is a longitudinal sectional view showing a first connector housing and a second connector housing constituting a lever connector according to the related art.

In a state in which fitting between the connector housings has been completed by a pivoting operation of the lever 30, the grommet 40 according to the present embodiment, as shown in FIG. 7C, is adapted such that the ridge 412 of the lip 41*b* is tightly contacted with the peripheral edge of the connector attaching hole 3*a* in an elastically deformed state by movement of the operation plates 32 toward the connector attaching plate 3, thereby ensuring the waterproofing property of preventing infiltration of water or the like into the first connector housing 10.

According to the lever connector 1 of the present embodiment as described above, the grommet 40 ensuring the waterproofing property of the inside of the first connector housing 10 has no portion, which is mounted inside the first connector housing 10, and is attached on the operation plates 32 of the lever 30, which are exposed to the outside of the first connector housing 10. Therefore, it is not necessary to ensure a volume for accommodating the grommet 40 inside the first connector housing 10. As a result, increasing in size of the connector housings to allow the grommet 40 to be mounted therein is prevented.

Also, according to the lever connector 1 of the present embodiment as described above, the grommet 40 is attached on the operation plates 32 of the lever 30, which are exposed to the outside of the first connector housing 10, and thus as compared to conventional cases in which a portion of the grommet 140 is fitted into the first connector housing 110, the grommet 40 is easily mounted, thereby enhancing assembly efficiency.

Further, according to the lever connector 1 of the present embodiment as described above, when the first connector housing 10 is fitted into the second connector housing 20, which has been temporarily fixed on the connector attaching plate 3 by the panel fixing pieces 22, the temporary fixation maintaining devices 12 of the first connector housing 10, as shown in FIG. 6A, restrict a bending displacement of the panel fixing pieces 22 while fitting is being performed. Therefore, the second connector housing 20 is maintained in a fixed state to the connector attaching plate 3 by means of the panel fixing pieces 22. In addition, if the first connector housing 10 has been completely fitted into the second connector housing 20, the restriction to the bending displacement of the panel fixing pieces 22 by the temporary fixation maintaining devices 12 is released as shown in FIGS. 6B and 6C. As a result, due to a pressing force exerted from the first connector housing 10 to the second connector housing 20, as shown in FIG. 6C, the second connector housing 20 is displaced in a direction, in which the second connector housing 20 is pushed out of the connector attaching hole 3*a*. At this time, such a displacement is stopped when the main fixing devices 35 respectively provided on the operation plates 32 of the lever 30 has been engaged with the housing fixing portion 3*b* of the connector attaching plate 3.

In other words, there is a significant change between attaching locations of the second connector housing 20 to the connector attaching plate 3 before and after the fitting connection of the first connector housing 10 has been completed. Therefore, whether or not the fitting connection between the connector housings has been successfully completed is simply distinguished by observing the external appearance.

In addition, according to the lever connector 1 of the present embodiment as described above, the lever 30 adapted to force the first connector housing 10 to be fitted and connected to the second connector housing 20 is constituted of a pair of half levers 30*a* and 30*b* having the same structure, thereby inhibiting increase of component types to be manufactured and achieving reduction of manufacturing cost.

Meanwhile, the present invention is not limited to the foregoing embodiment, but appropriate changes, modifications or the like thereof is made. In addition, material, shape, direction, number, installation position and the like of each of the components of the foregoing embodiment are not limited but arbitrary as long as the present invention is achieved.

For example, an attaching position of the second connector housing is not limited to a panel of vehicles or the like, but may be a wall surface or the like of a case for various electronic and electrical equipment.

INDUSTRIAL APPLICABILITY

According to the lever connector of the present invention, the grommet is attached on the operation plates of the lever, which are exposed to the outside of the first connector housing. Therefore, it is not necessary to ensure a volume for accommodating the grommet inside the first connector housing. As a result, increasing in size of the connector housings to allow the grommet to be mounted therein is prevented.

Also, according to the lever connector of the present invention, the grommet is attached on the operation plates of the lever, which are exposed to the outside of the first connector housing, and thus as compared to conventional cases in which a portion of the grommet is fitted into the first connector housing, the grommet is easily mounted, thereby enhancing assembly efficiency.

REFERENCE NUMERALS LIST

1 Lever connector
3 Connector attaching plate
3*a* Connector attaching hole
3*b* Housing fixing portion
10 First connector housing.
12 Temporary fixation maintaining devices
14 Lever supporting shaft
20 Second connector housing
21 Distal fitting portion
22 Panel fixing pieces
23 Positioning flange
30 Lever
30*a*, 30*b* Half lever
31 Lever bodies
32 Operation plates
35 Main fixing devices
40 Grommet
41 Operation plate covering portion
41*a* Covering portion body
41*b* Lip
42 Tubular portion
411 Groove

The invention claimed is:

1. A lever connector, comprising:

a first connector housing;

a second connector housing that includes a distal fitting portion to which a distal end of the first connector housing is fittedly connected, and is attached to a connector attaching plate in a state of inserting the second connector housing through a connector attaching hole of the connector attaching plate;

a lever pivotally that is equipped on the first connector housing and fits the first connector housing into the second connector housing by a pivoting operation of the lever; and a grommet that is mounted on the first connector housing and ensures a waterproofing property of an inside of the first connector housing, wherein the lever includes:

a lever body pivotally coupled to the first connector housing and pulls the first connector housing into the second connector housing by pivoting the lever; and an operation plate that is extended from a rear end of the lever body and serves as an operation portion for pivoting the lever body, and wherein when fitting between the connector housings is completed by the pivoting operation, the operation plate is moved toward the connector attaching plate in a state where the operation plate is parallel to the connector attaching plate and protrudes beyond an outer peripheral of the first connector housing in a flange shape; and wherein the grommet includes:

an operation plate covering portion that is coupled to the operation plate by a lip of the operation plate covering portion, the lip having a groove to be fitted on an outer peripheral edge of the operation plate; and a tubular portion that is integrally formed with the operation plate covering portion and receives a cable connected to the first connector housing, and wherein when fitting between the connector housings has been completed by the pivoting operation of the lever, the lip is tightly contacted with a peripheral edge of the connector attaching hole by movement of the operation plate toward the connector attaching plate to ensure the waterproofing property of the inside of the first connector housing.

2. The lever connector according to claim 1, wherein the second connector housing includes a panel fixing piece that performs a temporary fixation to the connector attaching plate when the distal fitting portion is inserted through the connector attaching hole in a state where the second connector housing is not connected to the first connector housing, wherein the first connector housing includes a temporary fixation maintaining device that restricts a bending displacement of the panel fixing piece while the first connector housing is being fitted into the second connector housing to maintain the second connector housing in a fixed state to the connector attaching plate by the panel fixing piece, and that releases the restriction to the bending displacement of the panel fixing piece to allow a displacement of the second connector housing relative to the connector attaching plate when the first connector housing is completely fitted into the second connector housing, and wherein the operation plate of the lever includes a main fixation device that is engaged with a housing fixing portion of the connector attaching plate to fix the first connector housing to the connector attaching plate in a state where the lip is tightly contacted with the peripheral edge of the connector attaching hole, when the operation plate is pressed against the connector attaching plate in a state where the first connector housing is completely fitted into the second connector housing.

3. The lever connector according to claim 1, wherein the first connector housing is provided with a lever supporting shaft for pivotally supporting the lever, on a symmetrical axis extending through the center of a width direction of the first connector housing, and wherein the lever includes a pair of half levers supported by the lever supporting shaft and pulls the first connector housing into the second connector housing when being pivoted in opposite directions to each other, the pair of half levers having the same structure.

4. The lever connector according to claim 2, wherein the first connector housing is provided with a lever supporting shaft for pivotally supporting the lever, on a symmetrical axis extending through the center of a width direction of the first connector housing, and wherein the lever includes a pair of half levers supported by the lever supporting shaft and pulls the first connector housing into the second connector housing when being pivoted in opposite directions to each other, the pair of half levers having the same structure.

* * * * *